United States Patent [19]

Garrison

[11] 4,145,939

[45] Mar. 27, 1979

[54] DRAIN PLUG HOLDER

[76] Inventor: Ward S. Garrison, P.O. Box 1773, Sedona, Ariz. 86336

[21] Appl. No.: 809,602

[22] Filed: Jun. 24, 1977

[51] Int. Cl.[2] ..... B25B 13/06; B25B 13/58

[52] U.S. Cl. ..... 81/125; 81/185

[58] Field of Search ..... 184/1.5, 106; 81/177 R, 81/180 R, 185, 125, 1; 248/206 A; 59/93; 24/201 B, 73 MS

[56] References Cited

U.S. PATENT DOCUMENTS

| | | | |
|---|---|---|---|
| 1,346,061 | 7/1920 | Rosenberg | 81/185 |
| 1,622,192 | 3/1927 | Finkle | 81/125 X |
| 2,210,742 | 8/1940 | Whitney | 81/177 R |
| 2,697,958 | 12/1954 | Kozakewich | 81/185 |
| 2,834,241 | 5/1958 | Chowning | 81/125 |
| 3,068,573 | 12/1962 | Sidwell | 248/206 A |
| 3,126,774 | 3/1964 | Carr et al. | 81/125 |
| 3,151,511 | 10/1964 | Brase | 81/177 R X |
| 3,867,999 | 2/1975 | Cox | 184/1.5 |
| 3,869,945 | 3/1975 | Zerver | 81/125 |
| 3,916,736 | 11/1975 | Clemens | 81/185 |

*Primary Examiner*—David H. Brown

*Attorney, Agent, or Firm*—Fishburn, Gold & Litman

[57] ABSTRACT

A drain plug holder assembly includes a socket adapted for engaging and rotating a drain plug and includes liner members for insertion therein, having various thicknesses and designs to accommodate differently sized and shaped drain plugs. The socket has a plug retaining magnet positioned and connected therein, and a spindle which projects outwardly from the socket to facilitate manual turning of the socket and drain plug. The socket is tethered by a flexible cord or chain to an anchor, which is in turn, readily attachable to a stationary structural member for retaining the socket, as well as the drain plug held therein.

4 Claims, 4 Drawing Figures

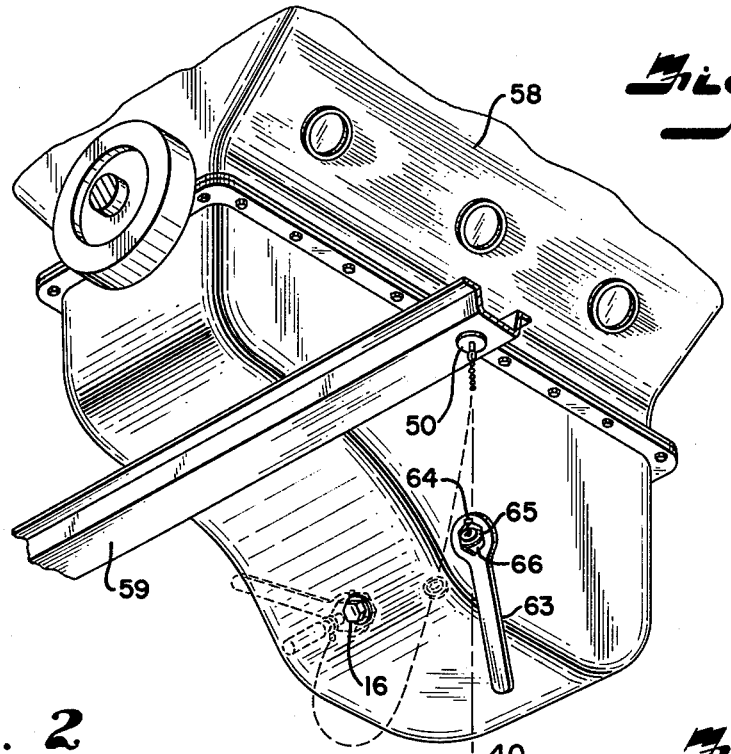
Fig. 1.
Fig. 2
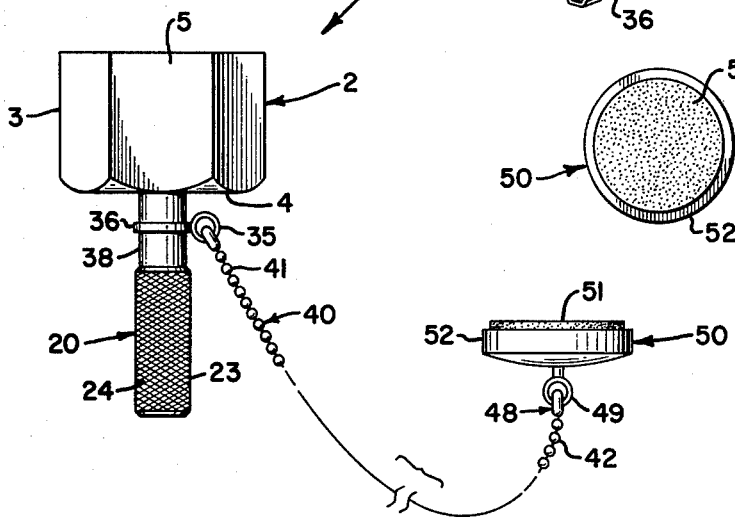
Fig. 3.
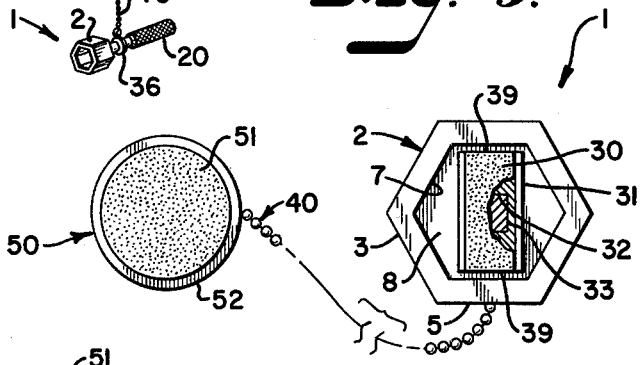
Fig. 4.
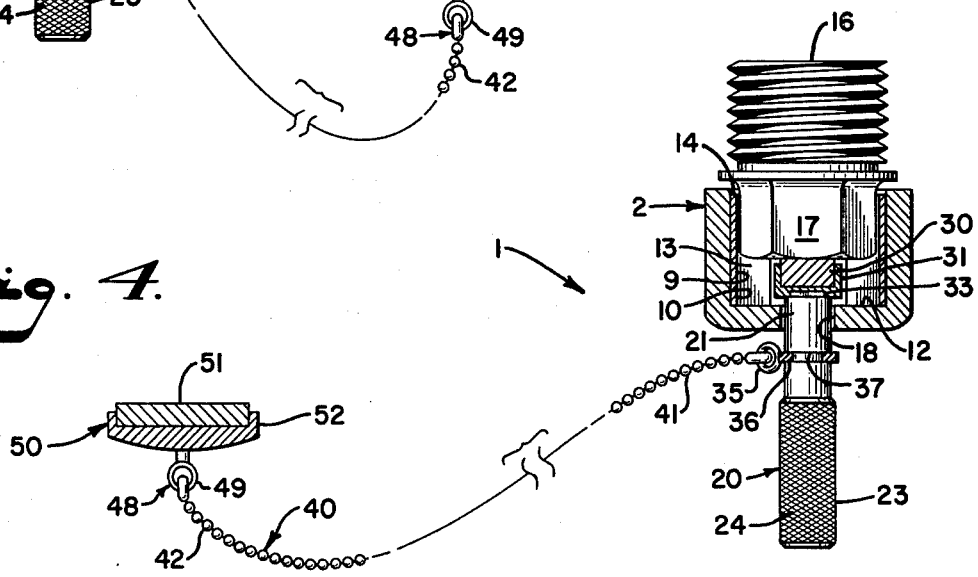

DRAIN PLUG HOLDER

This invention relates to a drain plug holder for facilitating the removal of drain plugs from fluid holding tanks or sumps, and in particular, to a holder for vehicle engine drain plugs, and the like.

BACKGROUND OF THE INVENTION

Of continuing annoyance to the mechanic or vehicle owner is the awkwardness and messiness of removing the fluid drain plugs from engine oil pans or sumps in automobiles, trucks boats, or the like. When removing the plug from the oil sump, the mechanic often turns the plug by hand until the last thread disengages, and then attempts to snatch the plug away from the on-rushing stream of often hot oil, trying not to drop the plug into the used oil receptacle. Too often, the plug slips and falls into the oil change pan and the mechanic must grope in the dirty oil to retrieve the plug. In other instances, the plug may become lost or mislaid, in effect disabling the vehicle, and requiring that another plug be obtained and installed before adding new oil and starting the engine.

Various prior art devices have attempted to solve the above problem, many of them incorporating long rods and offset turning arrangements such as represented by U.S. Pat. Nos. 1,686,749; 1,687,980 and 3,049,334. Other devices, U.S. Pat. Nos. 2,806,396 and 3,731,722, have attempted to generally solve the problem of retaining a bolt, nut or pin in tool. These devices have often been expensive to produce, awkward in use and undesirable for the purposes proposed herein.

The present invention includes a socket having a plug retaining magnet therein. The socket is fitted over a drain plug and is rotated, thereby removing the plug from the sump and retaining the plug within the socket. The socket is tethered to an anchor which is readily connectible to a vehicle frame member or the like, to prevent dropping and/or misplacing of the drain plug.

The principle objects of the present invention are: to provide a drain plug holder assembly adapted to receive and securely yet detachably retain a drain plug therein; to provide such a plug holder adapted for insertion of liners therein to accommodate a plurality of variously sized drain plugs; to provide such a holder assembly having flexible means tethering the holder to a structural member; to provide such a holder assembly having an anchor for detachably connecting the holder to a vehicle frame member or to an engine portion; to provide such an assembly having wrench means associated therewith for loosening the drain plug; and to provide such a drain plug holder assembly which is relatively inexpensive, sturdy and efficient in use and particularly well adapted for the intended purpose.

Other objects and advantages of this invention will become apparent from the following description taken in connection with the accompanying drawings wherein are set forth, by way of illustration and example, certain embodiments of this invention.

FIG. 1 is a perspective view of a plug holder assembly embodying the present invention, is shown and, in connection with a portion of the undercarriage of a vehicle, and includes a wrench member.

FIG. 2 is a side elevational view of the plug holder assembly.

FIG. 3 is a plan view of the plug holder assembly having a portion thereof broken away.

FIG. 4 is a cross-sectional view of the plug holder assembly, having a liner and a drain plug disposed therein.

Referring to the drawings in more detail:

As required, detailed embodiments of the present invention are disclosed herein, however, it is to be understood that the disclosed embodiments are merely exemplary of the invention which may be embodied in various forms, therefore, specific structural and functional details disclosed herein are not to be interpreted as limiting, but merely as a basis for the claims and as a representative basis for teaching one skilled in the art to variously employ the present invention in virtually any appropriately detailed structure.

The reference numeral 1 generally indicates a plug holder assembly embodying the present invention. The assembly includes a socket member 2 having side portions or walls 3 with external gripping surfaces 5 thereon, and a plate member or bottom 4 (FIG. 2) connected therewith. The exterior side portion of the socket member 2 is adapted for engagement by a tool member for rotating the same, and in the illustrated example, has a conventional, hexagonal shape, although other shapes, such as square, octagonal or even circular with external gripping surfaces may be employed. The socket member 2 is hollow and includes interior surfaces or faces 7 which are shaped to mate with and engage a similarly shaped portion of the drain plug. The interior surfaces 7 of the walls 3, in combination with the inner surface 12 (FIGS. 3 and 4) of the bottom 4, form a drain plug receiving cavity or chamber 8. In this example, the interior surfaces 7 are substantially flat and axially aligned in the socket, and have a conventional, 6-point design. To facilitate manufacturing economy, the socket member 2 is so designed that the drain plug receiving chamber 8 is shaped to fit the largest, commonly employed sump drain plugs. The socket member 2 may be constructed of virtually any suitable material which is sufficiently strong to withstand the sheer and bending forces applied thereto, such as steel, aluminum, or the like, and is preferably integrally constructed by means such as casting, drop forging and other well known procedures. The edge formed by the intersection of the side wall 3 and bottom 4, is, in this example, slightly rounded to facilitate the insertion of a tool thereover and placement onto the gripping surfaces 5.

A liner member 9 (FIG. 4) is provided to adapt the plug holder assembly to fit variously sized drain plugs. The liner 7 includes an exterior surface which is shaped to mate with and engage the interior surface of the socket member 2, and an interior surface which is shaped to mate with and engage the exterior surface of the drain plug. The cavity formed between the interior surfaces of the liner 9 form a second plug receiving chamber 13, having a marginal dimension somewhat smaller than that of the first chamber 8, and in this example, comprises substantially flat surfaces 10 arranged in a conventional, 6-point socket design, and includes an outer end 14. The liner 9 is preferably constructed of a relatively hard material which is resistant to deformation, such as steel, iron, tough polymeric resin materials, and the like. In this example, the liner 9 is shaped to receive and engage therein a conventionally designed sump drain plug 16, having a hexagonally shaped head 17. It is to be understood, that the present invention may be provided with a plurality of variously shaped liners to accommodate a variety of drain plug sizes and shapes. If the socket member 2 does not fit the drain plug on which the holder is to be used, the manufacturer and/or user simply selects a liner having a shape and size corresponding to the subject drain plug, and inserts the selected liner into the socket. The liner 9 is frictionally retained in the socket 2 to prevent relative lateral translation therebetween.

A spindle 20 is attached to the socket 2, and includes a portion adapted for grasping by the user and rotating the drain plug 16. The illustrated spindle 20 is slideably mounted in the socket for axial, reciprocal translation therein to accommodate use with variously sized drain plugs.

In the structure illustrated in FIG. 4, the socket bottom 4, includes coaxially aligned bore 18 extending therethrough. The spindle 20 is in the shape of an elongated cylindrical shaft member, and extends through the bore 18, and has an upper end 21 thereof suitably connected, such as described below, to a magnetic member 30 positioned in the chamber 13. Although magnetic member 30 may be comprised of various suitable materials, preferred is a powdered magnetic material incorporated in a resilient binder to comprise a permanent magnet. The magnet member 30 may be of various shapes including discs, rings, or bars, and is shown in FIG. 3 as a rectangular member or bar. A holder 31 for the magnetic member 30 is formed of plastic, brass, pot metal, aluminum or other non-magnetic metal or alloy and, is mounted to the magnetic member 30 by means such as adhesive, bonding, fasteners, or the like, and has a height less than the magnetic member 30 thereby permitting the same to project thereabove. As illustrated, in FIGS. 3 and 4, the holder 31 includes a square shaped aperture 32, and the upper end 21 of the spindle includes a mating, protuberance 33 inserted and secured in the bore 32 to fixedly interconnect the same, and retain the magnetic member 30 in the drain plug receiving 8 or 13. The lower end 23 of the spindle 20 has a knurled or otherwise roughened surface 24 to aid in gripping when turning the socket member 2 as described hereinafter. The spindle 20 is axially slideable in said bore 32 and is moveable with respect to the inner surface 12 of the socket bottom 4, whereby the magnetic member 30 may be translated to abut and magnetically engage the end surface of drain plug having various heights. The end edges 39 of the illustrated magnet and magnet holder 30 and 31 respectively, are each spaced a predetermined distance from the rotational axis of the spindle, whereby the inside faces of the drain plug receiving chamber lie in the rotational path of the magnetic and holder and abut the same. In this manner, rotation of the spindle 20 with respect to the liquid sump, selectively rotates the socket 2 in the same direction.

A flexible line member 40, such as a cable, chain, or the like, has one end thereof fastened to the socket 2. The other end of the line member 40 is connected with an anchor member 50, which is readily connectible and detachable to a stationary structural member such as the engine, the oil pan or sump, or frame members, herein representively illustrated as a typical vehicle engine 58 and a frame cross piece 59. The flexible line member 40 is connected to the spindle 20 by suitable fastening means 35. As shown by way of example, the fastening means 35 includes a freely rotating snap ring 36 positioned in a circumferential groove 37 on a midportion 38 of the spindle 20. The spindle 20 has limited reciprocating movement in the bore 18 of the socket member 2, and is restricted by contact between the snap ring 36 and the magnetic member 30 respectively with the socket bottom 4. This reciprocating movement permits the magnetic member 30 to extend upwardly within the chamber 13 and embrace and magnetically engage the drain plug 16 when positioned within the socket 2, FIG. 4. The flexible member 40 is secured at one end 41 to the freely rotatable snap ring 36, permitting the spindle 20 to be turned without wrapping or twisting the flexible member 40 therearound. The other end 42 of the flexible member 40 is secured to the anchor 50 by any suitable fastening means 48, herein shown as a split ring 49. The anchor 50 may be comprised of a clip, a bolt, or the like, and in the illustrated structure, comprises a second magnetic member 51 of the permanent type as described above, and includes a holder 52 bonded or otherwise suitably secured thereto. The magnetic member 51 has sufficient attracting strength to support the combined weight of the socket member 2, the drain plug 16 and a tool.

FIG. 1 illustrates a form of the assembly 1 which includes a spanner or closed end wrench member 63 providing grasping and turning means for the socket member 2. The wrench 63 is retained with the socket member 2 and anchor means 50 and is connected therewith by a notch 64 extending into the socket engaging opening 66 of the spanner 63. The flexible member 40 is positioned in the notch 64 and the spanner 63 is suspended from an abutment member or washer 65 positioned on the flexible member 40 and between the socket member 2 and the anchor means 50.

In the use of this invention, as illustrated in FIG. 1, the mechanic first attaches the anchor means to a suitable frame, tank, or engine portion 57 and the socket member 2 and the wrench 63 are depended therefrom by means of the flexible member 40. The socket member 2 is fitted over the drain plug 16, and the magnetic member 30 is extended inwardly toward the drain plug and embraces and magnetically engages the end of the plug. The wrench 63 is then detached from the flexible line 40, positioned over the socket 2, and rotated, to loosen the plug 16 until it can be turned by hand. Next, the spindle 20 is grasped by the user and manually rotated. Rotation of the spindle imparts rotation to the socket 2 and drain plug 16, and the same is turned until the last thread retaining the plug 16 is disengaged from the sump. The socket member and retained drain plug 16 may then be dropped clear of the on-rushing stream of fluid or oil, and the two members remaining securely attached to each other and the frame member or engine of the vehicle. The retained plug 16 is thereby prevented from being dropped into a waste oil pan or otherwise lost or misplaced. The plug 16 can be reassembled in the engine 58 by reversing the above recited steps, without the mechanic touching the oily plug. The magnetic member 30 and socket 2 are separated from the drain plug, the anchor 50 is detached from the frame cross piece 59, and the assembly 1 is transported to a remote location for storage.

It is to be understood that while one form of this invention has been illustrated and described, it is not to be limited to the specific form or arrangement of parts herein described and shown, except insofar as such limitations are included in the following claims.

What is claimed and desired to secure by Letters Patent is:

1. A drain plug holder assembly for use in changing oil in a crankcase of an engine comprising:

(a) a socket member having a side wall, a bottom wall and an open end, said walls defining a chamber for receiving a head of an engine crankcase drain plug, said chamber having a shape substantially corresponding to the shape of a drain plug head;

(b) said socket member including exterior wall portions having a plurality of substantially planar gripping surfaces thereon shaped for grasping by a tool and for turning said socket member with respect to said drain opening of said engine crankcase and loosening said drain plug retained therein;

(c) said socket member has an axial opening extending through said bottom wall thereof;

(d) a magnetic member positioned in said chamber and connected to said socket member and operative to attract and separately retain the drain plug head in said socket;

(e) an elongate flexible member having first and second ends with the first end connected with said socket member;

(f) anchor means connected to the second end of the flexible member and detachably connected to a structural member adjacent to an engine crankcase for retaining the socket member and drain plug engaged therewith and preventing inadvertent loss upon removal of the drain plug from the engine crankcase;

(g) said anchor means connected to said second end of the flexible member being a second magnet member for detachable connection with said structural member;

(h) a spindle member having a first end thereof in said drain plug receiving chamber and connected to said first magnet member, said spindle member extending through said axial opening and having a second end thereof extending outwardly from said socket member and being shaped for grasping and selectively rotating said drain plug;

(i) said spindle member is slidably mounted in said socket for axial, reciprocal translation therein, whereby said first magnet member is extendibly movable within said drain plug receiving chamber to magnetically engage said drain plug head;

(j) said spindle member includes a circumferential groove; and (k) the connection of the first end of the flexible member includes a ring member rotatably mounted in said circumferential groove and said spindle member is rotatable relative to said flexible member.

2. A plug holder assembly as set forth in claim 1 wherein:

(a) said spindle member is reciprocally slideable in said axial opening and socket for a predetermined distance; and (b) said ring member is positioned on a portion of said spindle member extending outwardly of said socket member bottom wall, whereby said predetermined distance is defined by the respective longitudinal separation between said magnetic member and said bottom and said ring member and said bottom wall and is limited thereby.

3. A plug holder assembly as set forth in claim 2 wherein:

(a) said drain plug receiving chamber comprises a first receiving chamber; and including (b) a liner member having an exterior shape corresponding to the shape of said receiving chamber for positioning therein and detachable connection therewith; said liner member having interior faces defining a second receiving chamber sized for engaging a correspondingly sized drain plug head therein.

4. A drain plug holder assembly for use in changing oil in a crankcase of an engine comprising:

(a) a socket member having a side wall, a bottom wall and an open end, said walls defining a chamber for receiving a head of an engine crankcase drain plug, said chamber having a shape substantially corresponding to the shape of a drain plug head;

(b) said socket member including exterior wall portions having a plurality of substantially planar gripping surfaces thereon shaped for grasping by a tool and for turning said socket member with respect to said drain opening of said engine crankcase and loosening said drain plug retained therein;

(c) said socket member has an axial opening extending through said bottom wall thereof;

(d) a magnetic member positioned in said chamber and connected to said socket member and operative to attract and separately retain the drain plug head in said socket;

(e) an elongate flexible member having first and second ends with the first end connected with said socket member;

(f) anchor means connected to the second end of the flexible member and detachably connected to a structural member adjacent to an engine crankcase for retaining the socket member and drain plug engaged therewith and preventing inadvertent loss upon removal of the drain plug from the engine crankcase;

(g) said anchor means connected to said second end of the flexible member being a second magnet member for detachable connection with said structural member;

(h) a spindle member having a first end thereof in said drain plug receiving chamber and connected to said first magnet member, said spindle member extending through said axial opening and having a second end thereof extending outwardly from said socket member and being shaped for grasping and selectively rotating said drain plug;

(i) said spindle member is slidably mounted in said socket for axial, reciprocal translation therein, whereby said first magnet member is extendibly movable within said drain plug receiving chamber to magnetically engage said drain plug head; and (j) means rotatably connecting the first end of the flexible member with said spindle member, whereby said socket member is rotatably with respect to said engine structural member to permit removal of said plug without twisting the flexible member.

* * * * *